US007186183B2

(12) United States Patent
Zeilinger et al.

(10) Patent No.: US 7,186,183 B2
(45) Date of Patent: Mar. 6, 2007

(54) MOUNTING SYSTEM FOR A SWING

(75) Inventors: Brian K. Zeilinger, Jamesville, WI (US); Richard R. Popp, Beloit, WI (US)

(73) Assignee: PlayStar, Inc., Janesville, WI (US)

( * ) Notice: Subject to any disclaimer, the term of this patent is extended or adjusted under 35 U.S.C. 154(b) by 0 days.

(21) Appl. No.: 11/016,170

(22) Filed: Dec. 17, 2004

(65) Prior Publication Data

US 2006/0135273 A1 Jun. 22, 2006

(51) Int. Cl.
*A63G 9/12* (2006.01)
*A63G 9/00* (2006.01)

(52) U.S. Cl. ..... 472/118; 472/125; 248/65; 248/370

(58) Field of Classification Search ..... 472/118–125; 297/273; 248/65, 72, 370
See application file for complete search history.

(56) References Cited

U.S. PATENT DOCUMENTS

| | | | | |
|---|---|---|---|---|
| 555,981 | A | 3/1896 | Streeter | |
| 1,352,317 | A * | 9/1920 | Schwarz | 472/121 |
| 1,657,243 | A | 1/1928 | Daniels | |
| 1,939,223 | A | 12/1933 | Palmer | |
| 2,513,021 | A * | 6/1950 | Harrold | 472/122 |
| 2,823,002 | A | 2/1958 | Savitz | |
| 3,145,013 | A | 8/1964 | Grudoski | |
| 3,391,932 | A | 7/1968 | Scalf | |
| 3,447,802 | A | 6/1969 | Gudoski | |
| 3,503,582 | A | 3/1970 | Boucher | |
| 3,782,724 | A | 1/1974 | Rottman et al. | |
| 4,018,538 | A | 4/1977 | Smyrni et al. | |
| 4,155,548 | A | 5/1979 | Smith et al. | |
| 4,961,558 | A | 10/1990 | Cunard | |
| 5,154,672 | A * | 10/1992 | Brown | 472/118 |
| 5,326,326 | A | 7/1994 | Cunard et al. | |
| 5,393,268 | A | 2/1995 | Cunard et al. | |
| 6,039,654 | A | 3/2000 | Zeilinger | |
| 6,068,557 | A | 5/2000 | Zeilinger | |
| 6,302,801 | B1 | 10/2001 | Zeilinger | |

OTHER PUBLICATIONS

Admitted Prior Art PlayStar, Inc. Bracket Assembly, p. 1.
Admitted Prior Art Swing 'N' Slide Bracket Assembly, pp. 1-2.

* cited by examiner

*Primary Examiner*—Kien Nguyen
(74) *Attorney, Agent, or Firm*—Michael Best & Friedrich LLP

(57) ABSTRACT

A mounting system for mounting a swing to a support beam includes a first bracket member coupled to the support beam, a second bracket member coupled to the support beam opposite the first bracket member, a first swing hanger directly connected to the first bracket member for supporting a first elongated support member, and a second swing hanger directly connected to the second bracket member for supporting a second elongated support member.

29 Claims, 3 Drawing Sheets

MOUNTING SYSTEM FOR A SWING

FIELD OF THE INVENTION

The invention relates to children's playground equipment, and more particularly to mounting arrangements for interconnecting a swing chain or the like to playground equipment.

BACKGROUND OF THE INVENTION

A variety of children's play accessories (e.g., swings, rides, and gymnastics equipment) are attached to playstations by hanging them from a support (e.g., a beam) on the playstation. The accessories are typically hung on one or more link-type chains, ropes, or other suitable members connected to an eyelet, S-hook, or other connecting device on the playstation.

SUMMARY OF THE INVENTION

In one embodiment, the invention provides a mounting system for mounting a swing to a support beam. The mounting system includes a first bracket member coupled to the support beam, a second bracket member coupled to the support beam opposite the first bracket member, a first swing hanger directly connected to the first bracket member for supporting a first elongated support member, and a second swing hanger directly connected to the second bracket member for supporting a second elongated support member.

In one aspect of the invention, there is no interconnecting member above a top surface of the support beam or below a bottom surface of the support beam that extends between and is directly connected to each of the first and second bracket members.

In another embodiment, the invention provides a children's playstation including a support beam, a swing coupled to the support beam by at least four elongated support members, and a mounting system for connecting the elongated support members to the support beam. The mounting system includes at least four bracket members mounted to the support beam, and a swing hanger directly connected to each of the bracket members. Each swing hanger supports a respective one of the elongated support members.

In one aspect of the invention, the at least four bracket members are mounted in two spaced apart pairs, with one bracket member of each pair mounted to one side of the support beam and the other bracket member of each pair mounted to an opposite side of the support beam. There is no interconnecting member above a top surface of the support beam or below a bottom surface of the support beam that extends between and is directly connected to each of the bracket members in a respective pair.

Other features and advantages of the invention will become apparent to those skilled in the art upon review of the following detailed description, claims, and drawings.

Figure 1:
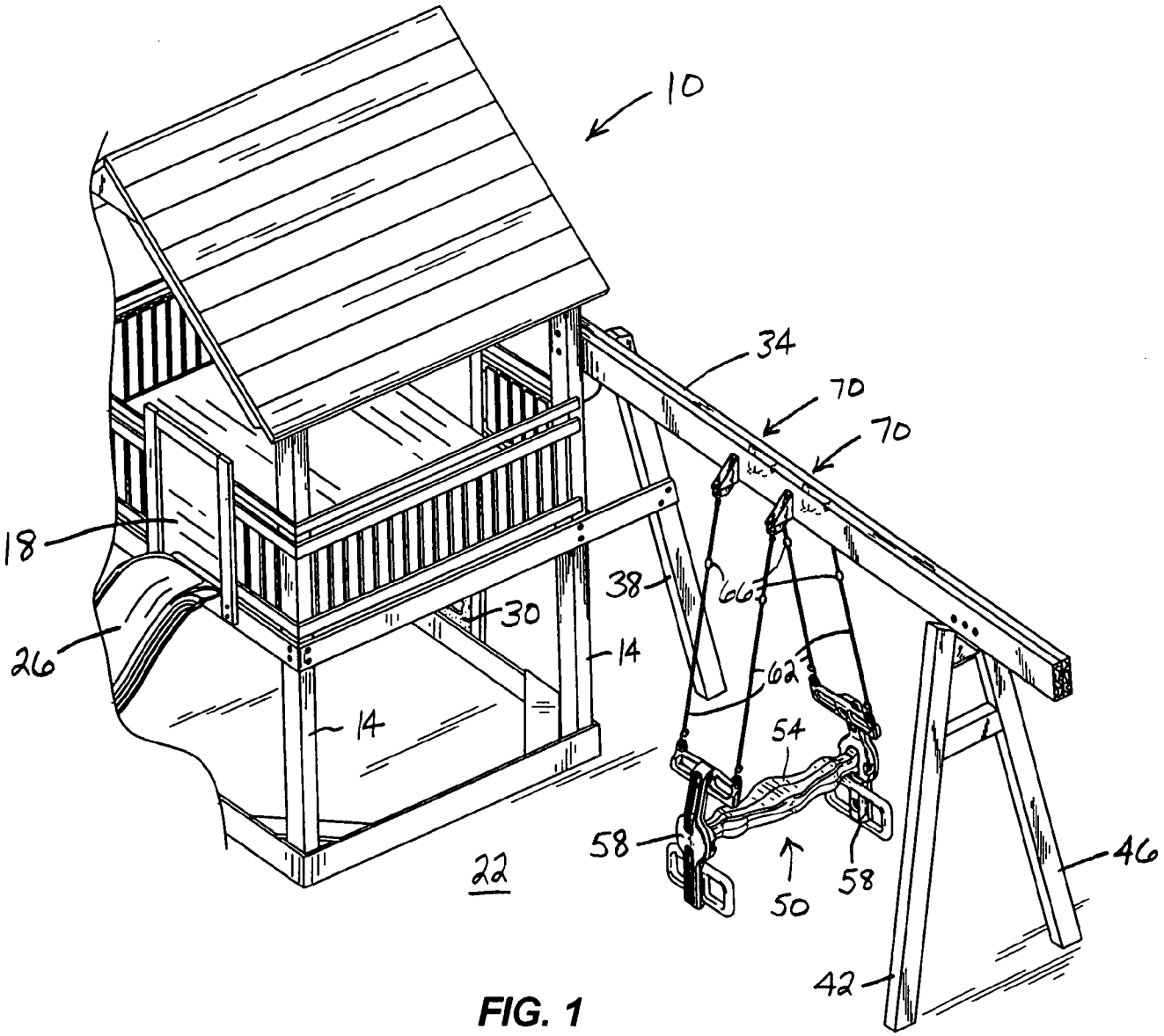
FIG. 1 is a partial perspective view of a playstation including a mounting system embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

DETAILED DESCRIPTION

FIG. 1 illustrates a playstation 10 of the type typically used by children for recreational play. The playstation 10 includes a plurality of legs 14 that support an elevated support structure or platform 18 above a lower support surface, such as the ground 22. As shown, a slide 26 may be coupled to the playstation 10 to allow children to slide from the platform 18 down to the ground 22. A climbing panel or ladder 30 is coupled to the playstation 10 to provide a way for children to climb from the ground 22 up to the platform 18. Of course, other configurations of ladders, steps, or climbing panels can also be used.

A support member in the form of a beam 34 is coupled to one of the legs 14 and extends away from the platform 18. In the illustrated embodiment, the support beam 34 comprises two pieces of standard 2"×6" lumber coupled together. However, the support beam 34 can be configured and constructed in any suitable manner capable of supporting swings or other devices to be coupled to the playstation 10. In the illustrated embodiment, a first support leg 38 is coupled to the end of the beam 34 adjacent the platform 18. Second and third support legs 42, 46, respectively, are coupled to the end of the beam 34 that is spaced from the platform 18. The support legs 38, 42, and 46 can be coupled to the support beam 34 in any suitable manner, and in the illustrated embodiment are connected to the support beam 34 using brackets of the type disclosed in U.S. Pat. Nos. 6,039,654 and 6,302,801 assigned to PlayStar, Inc. and hereby incorporated by reference.

As shown in FIG. 1, the support beam 34 supports a swing 50 configured to be ridden by two children. Of course, the illustrated swing 50 is just one example of a swing ride that can be used with the playstation 10, and other swing rides can be substituted. Additionally, while not shown, other rides and climbing features (e.g., rings, monkey bars, etc.) can also be coupled to the playstation 10. The swing 50 generally includes a seat portion 54 and two hand/footrest portions 58 coupled to opposite ends of the seat portion 54. The illustrated swing 50 is supported by four elongated support members in the form of chains 62 that are connected to the hand/footrest portions 58 as shown. Quick link connectors 66 can be incorporated into the chains 62 to facilitate changing the swing 50 to another similar type of swing. Of course, ropes, cables, and other elongated support members can be substituted for the chains 62 as desired.

Figure 2:
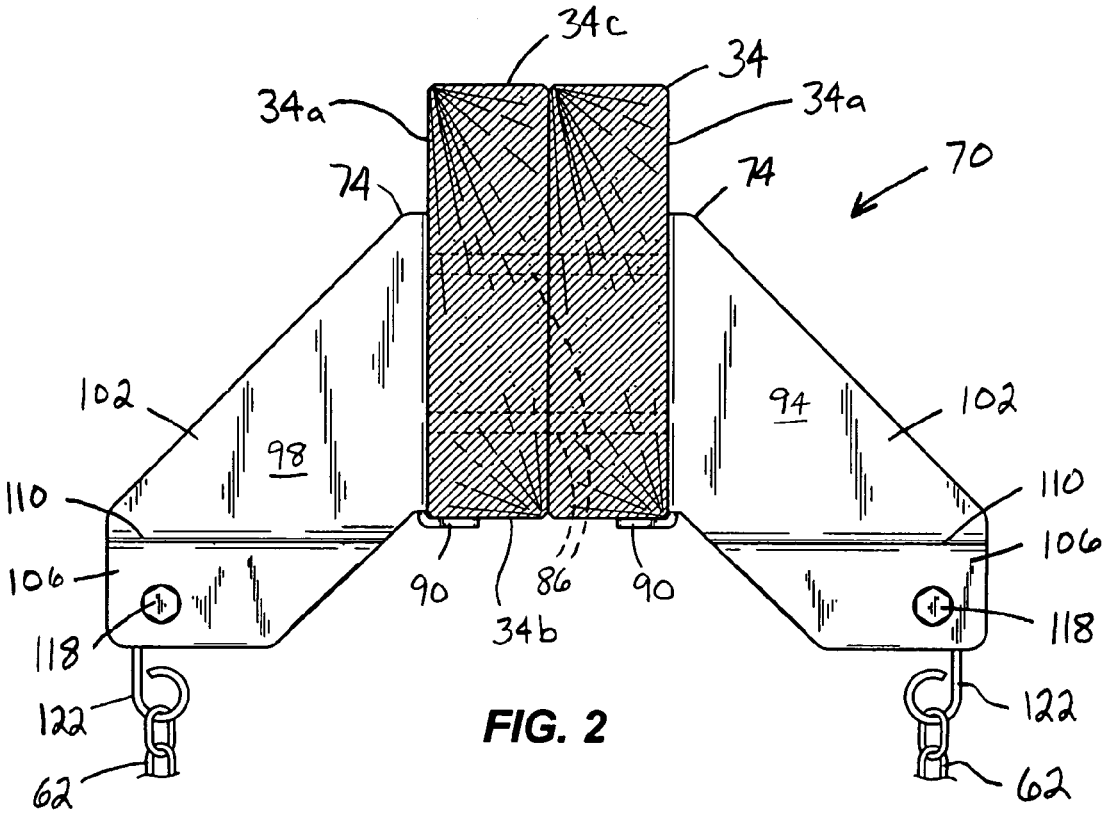
FIG. 2 is an enlarged partial end view showing a swing bracket assembly of the mounting system of FIG. 1 mounted to a support beam.
Figure 3:
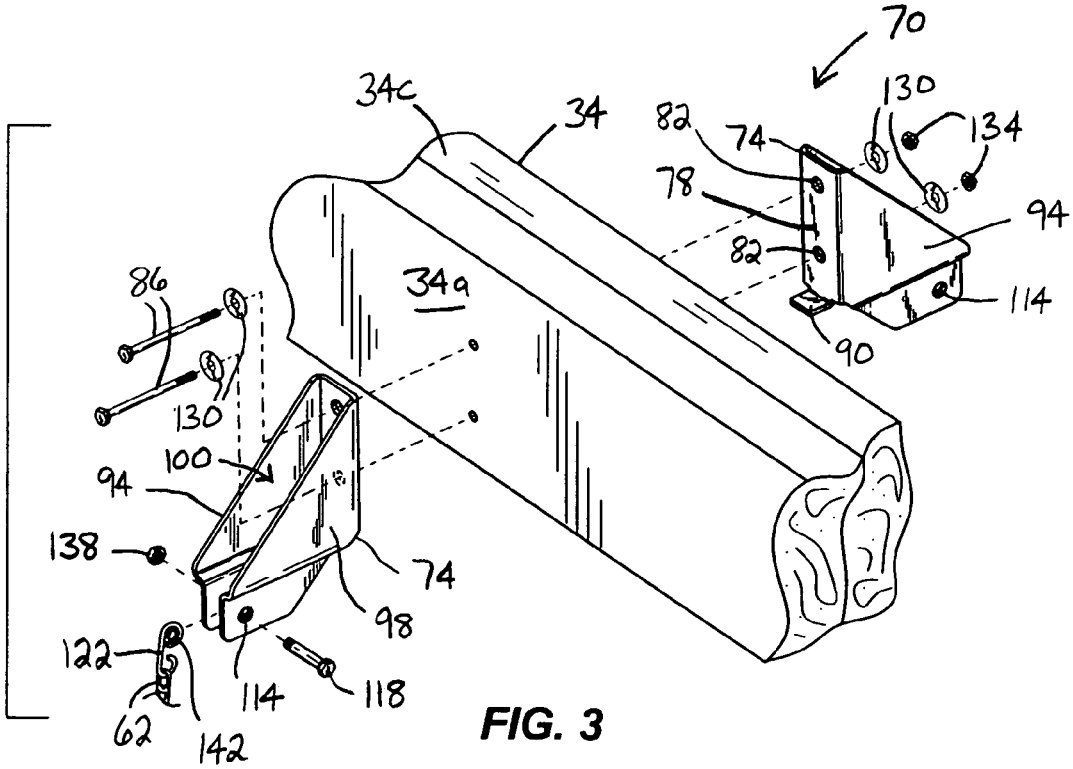
FIG. 3 is an exploded partial perspective view of the swing bracket assembly of FIG. 2.
Figure 6:
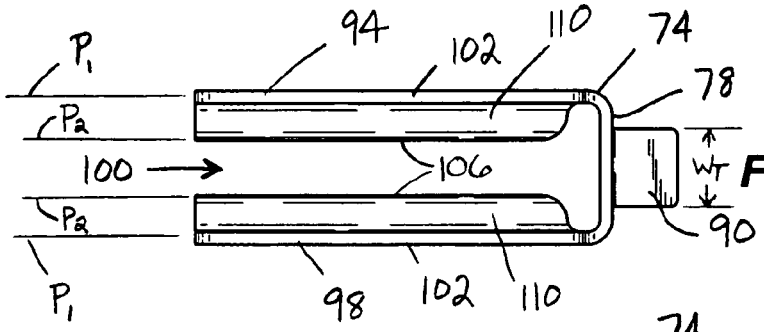
FIG. 6 is a top view of the swing bracket member of FIG. 4.

The chains 62 are coupled to the support beam 34 via a mounting system in the form of two swing bracket assemblies 70 that are mounted to the support beam 34. With reference to FIGS. 2 and 3, each swing bracket assembly 70 includes a pair of swing bracket members 74 that, in the illustrated embodiment, are substantially identical. The illustrated bracket members 74 are of a one-piece construction and are preferably fabricated by conventional stamping and bending processes. Alternatively, the bracket members 74 could be cast or forged. Any suitable material (e.g., steel) can be used for the bracket members 74. The bracket members 74 can be painted or otherwise coated to resist corrosion.

Figure 4:
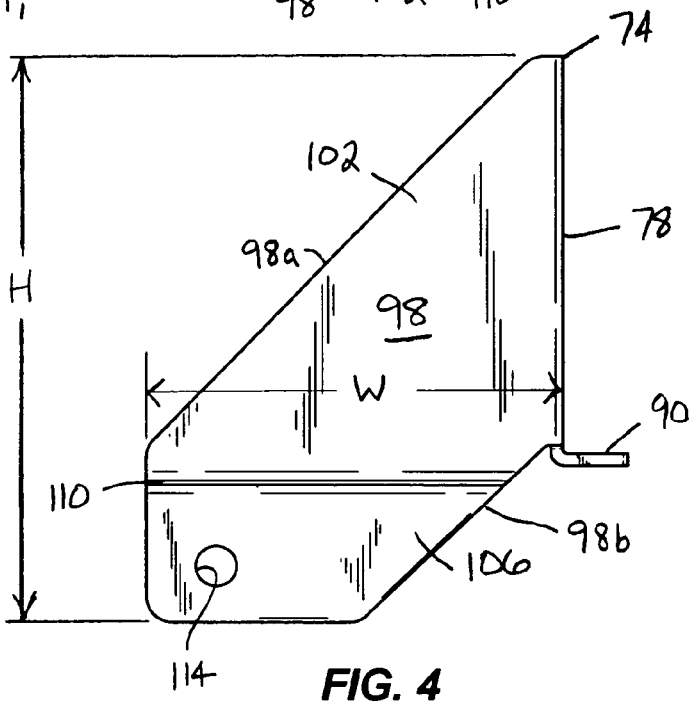
FIG. 4 is a right side view of one of the bracket members of the swing bracket assembly.
Figure 5:
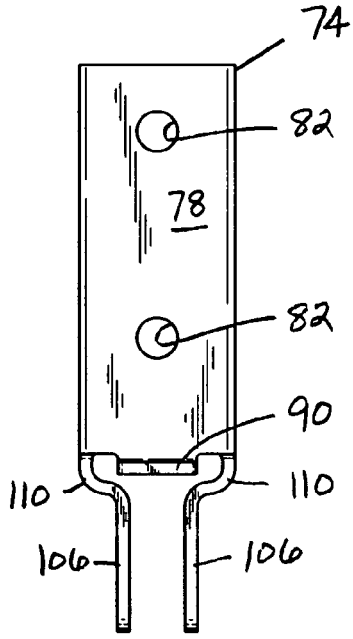
FIG. 5 is an end view of the swing bracket member of FIG. 4.

Referring now to FIGS. 4–7, each bracket member 74 includes a mounting wall 78 configured to abut a side surface 34*a* (see FIGS. 2 and 3) of the support beam 34 when mounted. As shown in FIG. 5, the mounting wall 78 is generally planar and rectangular in shape, having a height dimension of about 95 mm and a width dimension of about 30 mm. It should be noted that these and other dimensions provided herein are for the purpose of describing the illustrated embodiment, and may vary for other embodiments of the bracket members 74. The mounting wall 78 includes a pair of apertures 82 extending therethrough for receiving mounting bolts 86 (see FIGS. 2 and 3). In the illustrated embodiment, the apertures 82 are spaced apart by about 50 mm.

A tab 90 is coupled to the lower end of the mounting wall 78 and extends substantially perpendicularly to the mounting wall 78. The tab 90 is configured to abut a bottom surface 34*b* (see FIG. 2) of the support beam 34 when the bracket member 74 is mounted on the beam 34. Alternatively, the tab 90 could be positioned on the mounting wall 78 so as to abut a top surface 34*c* of the support beam 34. As will be described in greater detail below, the tab 90 facilitates aligning and mounting the bracket members 74 to the beam 34. The tab 90 has a width $W_T$ (see FIG. 6) of about 20 mm and extends about 15 mm outwardly from the mounting wall 78.

Each bracket member 74 further includes first and second sidewalls 94, 98 coupled to opposite edges of the mounting wall 78 and extending substantially perpendicularly away from the mounting wall 78. The sidewalls 94, 98 extend substantially parallel to one another and a define a channel 100 (see FIG. 6) therebetween. The channel 100 is open at its upper and lower ends to grant unimpeded access to the channel 100 for inserting and securing the mounting bolts 86, and for mounting the swing hanger as will be described below. Each sidewall 94, 98 includes a first portion 102 lying in a first plane $P_1$ (see FIG. 6) and a second portion 106 lying in a second plane $P_2$ (see FIG. 6). Each sidewall 94, 98 further includes a transition portion 110 joining the first and second portions 102, 106. With the sidewalls 94, 98 so constructed, the channel 100 is wider between the first portions 102 to facilitate inserting the mounting bolts 86 and securing tools therebetween, and narrows between the second portions 106 of the sidewalls 94, 98 for purposes that will be discussed below. In the illustrated embodiment, the first planes $P_1$ of the respective sidewalls 94, 98 are spaced apart by a distance of about 35 mm and the second planes $P_2$ are spaced apart by a distance of about 18 mm. In the illustrated embodiment, the first portion 102 of each sidewall 94, 98 has the general shape of a right-triangle and the second portion 106 of each sidewall 94, 98 has the general shape of a trapezoid.

An aperture 114 extends through the second portion 106 of each sidewall 94, 98 for receiving a support member in the form of a bolt 118 (see FIGS. 2 and 3) that supports a swing hanger 122 (see FIGS. 2 and 3). In alternative embodiments, the bolt 118 can be replaced with a rivet, pin or other generally cylindrical support member. The apertures 114 are located in the second portions 106 to be about 20–25 mm below the bottom surface 34*b* of the beam 34 and to be about 80–90 mm from the side surface 34*b* of the beam 34. By virtue of being supported on the bolt 118, the swing hanger 122 is directly connected to the bracket member 74 and is at least partially positioned between the sidewalls 94, 98 and at least partially within the narrowed portion of the channel 100. By virtue of the proximity of the second portions 106 (which together form the narrowed portion of the channel 100), the swing hanger 122 is constrained laterally between the sidewalls 94, 98 to permit substantially only pivoting movement of the swing hanger 122 in a plane parallel to the sidewalls 94, 98. While there can be some clearance between the swing hanger 122 and the second portions 106 to prevent binding, there is not enough clearance to permit substantial lateral movement of the swing hanger 122 on the bolt 118, which could detract from and/or hinder the swinging action.

It is also noted that the bolt 118 does not include a loop or eyelet for receiving the swing hanger 122. When swing hangers are mounted on loops or eyelets, there is a tendency for the swing hanger to move or ride-up on the loop or eyelet, thereby causing variation in the plane in which the swing hanger pivots. With the mounting system of the present invention, the swing hanger 122 will not deviate from the intended swing plane. Furthermore, because the channel 100 is open at its top and bottom ends (i.e., there is no top wall or bottom wall constraining the channel 100), the range of motion of the swing hanger 122 during swinging is not limited. In fact, prior to being connected to the chain 62, the swing hanger 122 is free to pivot 360 degrees around the bolt 118 within the channel 100.

Figure 7:
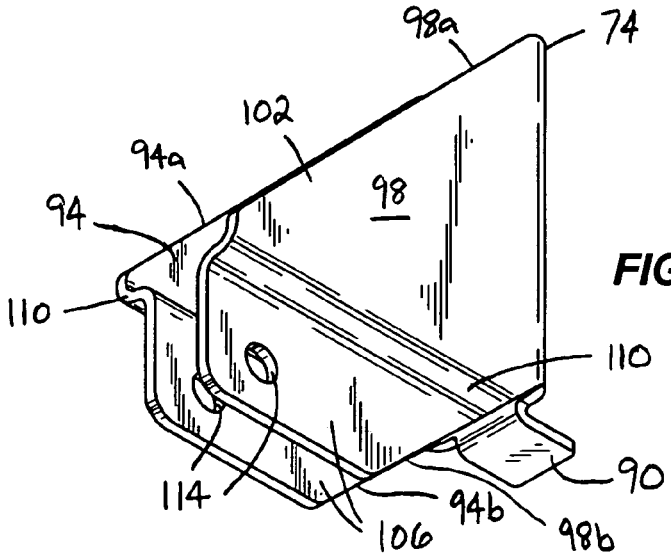
FIG. 7 is a perspective view of the swing bracket member of FIG. 4.

With reference to FIG. 4, it can be seen that each sidewall portion 94, 98 (and therefore the entire bracket member 74 itself) has an overall height H of about 135–145 mm, and more preferably about 140 mm, and an overall width W (excluding the tab 90) of about 95–100 mm, and more preferably about 97.5 mm. Furthermore, as best shown in FIGS. 4 and 7, it can also be seen that each sidewall 94, 98 includes two substantially parallel edges 94*a*, 94*b* and 98*a*, 98*b*, respectively.

With reference to FIG. 3, each swing bracket assembly 70 is mounted to the support beam 34 and assembled in the following manner. First, one bracket member 74 can be held in the desired position against the support beam 34 such that the mounting wall 78 abuts a side surface 34*a* of the beam 34 and the tab 90 abuts the bottom surface 34*b* of the beam 34. Marks can be made on the beam 34 in alignment with the apertures 82. Next, holes 126 can be drilled through the beam 34 for receiving the mounting bolts 86. The two bracket members 74 can then be secured to the beam 34 using the bolts 86 in combination with washers 130 and nuts 134. This process can then be repeated to mount the second swing bracket assembly 70. The design of each bracket member 74 provides that the heads of the mounting bolts 86, the washers 130, and the nuts 134 are all recessed within the channel 100. This provides an aesthetically pleasing construction, with the nuts and bolts heads largely hidden from view.

Next, the chain hangers 122 are secured to the respective bracket members 74 using bolts 118 and nuts 138 (only one set shown in FIG. 3). Alternatively, this step can be performed prior to mounting the bracket members 74 to the support beam 34. The illustrated chain hangers 122 each include a wear-resistant insert 142 (only one shown in FIG. 3) to provide a smooth swinging action. The hanger 122 is positioned between the second portions 106 of the respective sidewalls 94, 98 so that the bolt 118 passes through an aperture in the insert 142 and the apertures 114 in the second portions 106 to support the hanger 122 in the manner discussed above. Finally, the swing 50 can be connected by connecting the chains 62 to the respective swing hangers 122.

Unlike with prior art bracket assemblies, there is no interconnecting member (e.g., a metal tube or a board) above the top surface 34*c* of the support beam 34 or below the bottom surface 34*b* of the support beam 34 that extends between and is directly connected to each of the two bracket members 74. With these types of prior art bracket assemblies, the swing hangers are mounted directly to the interconnecting members, and not directly to the bracket members. Such interconnecting members add unnecessary expense to the prior art mounting systems, and make the assembly process more difficult. With these types of prior art mounting systems, the number of parts (including fastening hardware) is greatly increased, which increases the number of assembly steps required, and the overall difficulty of assembly.

Each bracket assembly 70 of the present invention includes only two, one-piece bracket members 74, two swing hangers 122, and the bolts 86 and 118 (with the associated washers and nuts). Because of the limited number of parts, the swing bracket assemblies 70 of the present invention are easy to mount to the support beam 34. The aligning tab 90 on each bracket member 74 facilitates vertical positioning of the bracket members 74 on the side surface 34*a* of the beam 34, and makes each individual bracket member 74 self-aligning, in that no other components of the mounting system need to be coupled to the individual bracket members 74 prior to mounting the brackets 74 to the support beam 34. Additionally, the two bracket members 74 of a bracket assembly 70 do not need to be coupled together prior to mounting the brackets 74 to the support beam 34.

The swing bracket assemblies 70 are also much easier to assemble than prior art mounting systems, such as those described above that incorporate an interconnecting member between the two brackets. Only four horizontally-oriented fasteners and two horizontal-direction drilling operations are required for assembling and mounting each bracket assembly 70 of the present invention onto the support beam 34. Prior art mounting systems typically require at least four drilling operations and at least six fasteners, which usually include at least two eye-bolts for supporting the swing hangers. In addition to the problems described above relating to the use of eye-bolts for supporting swing hangers for this type of swing application, these eye-bolts are typically oriented vertically, which can require vertical drilling or screwing operations. Additionally, the use of vertically-oriented fasteners can present upright protrusions that must be considered with respect to ASTM standards for playground equipment.

Various features of the invention are set forth in the following claims.

The invention claimed is:

1. A mounting system for mounting a swing to a support beam, the mounting system comprising:

a first bracket member coupled to the support beam;

a second bracket member coupled to the support beam opposite the first bracket member;

a first swing hanger directly connected to the first bracket member for supporting a first elongated support member; and a second swing hanger directly connected to the second bracket member for supporting a second elongated support member;

wherein each of the bracket members includes a mounting wall and two sidewalls extending generally perpendicularly from the mounting wall, and wherein the mounting wall of each bracket includes an aperture between the respective sidewalls and configured to receive a fastener.

2. The mounting system of claim 1, wherein there is no interconnecting member above a top surface of the support beam or below a bottom surface of the support beam that extends between and is directly connected to each of the first and second bracket members.

3. The mounting system of claim 1, wherein each swing hanger is pivotally mounted at least partially between the two sidewalls of the respective bracket member.

4. The mounting system of claim 3, wherein each swing hanger is constrained laterally between the respective sidewalls to permit substantially only pivoting movement in a plane parallel to the respective sidewalls.

5. The mounting system of claim 3, wherein the two sidewalls of each bracket member define a respective channel with no top or bottom wall such that prior to being connected to their respective elongated support members, each swing hanger is free to pivot 360 degrees within the respective channel.

6. The mounting system of claim 3, wherein each swing hanger is mounted on a member that does not include a loop or eyelet.

7. The mounting system of claim 1, wherein each bracket member includes an alignment tab extending from the mounting wall in a direction opposite the sidewalls, the alignment tab abutting one of a bottom surface and a top surface of the support beam to align the bracket member vertically with respect to the support beam.

8. The mounting system of claim 7, wherein the alignment tab abuts the bottom surface of the support beam.

9. The mounting system of claim 1, wherein the mounting wall of each bracket member includes two apertures between the sidewalls, both apertures configured to receive a fastener.

10. The mounting system of claim 1, wherein the two sidewalls of each bracket member define a respective channel having a first width in the vicinity of the aperture and a second width in the vicinity where the respective swing hanger is connected, the second width being narrower than the first width.

11. The mounting system of claim 1, wherein the first swing hanger is supported by a support member extending between the sidewalls of the first bracket member, and wherein no additional part is positioned between the sidewalls of the first bracket member and the swing hanger.

12. The mounting system of claim 1, wherein the first swing hanger is supported by a support member extending between the sidewalls of the first bracket member, the first swing hanger including an insert engaging the support member, and wherein no additional part is positioned between the sidewalls of the first bracket member and the swing hanger.

13. The mounting system of claim 1, wherein each bracket member is a one-piece construction.

14. A children's playstation comprising:

a support beam;

a swing coupled to the support beam by at least four elongated support members; and a mounting system for connecting the elongated support members to the support beam, the mounting system including;

at least four bracket members mounted to the support beam; and a swing hanger directly connected to each of the bracket members, each swing hanger supporting a respective one of the elongated support members such that the elongated support members can be de-coupled from the respective swing hangers without disconnecting the swing hangers from the bracket members.

15. The playstation of claim 14, wherein the at least four bracket members are mounted in two spaced apart pairs, with one bracket member of each pair mounted to one side of the support beam and the other bracket member of each pair mounted to an opposite side of the support beam, and wherein there is no interconnecting member above a top surface of the support beam or below a bottom surface of the support beam that extends between and is directly connected to each of the bracket members in a respective pair.

16. The playstation of claim 14, where each of the bracket members includes a mounting wall and two sidewalls extending generally perpendicularly from the mounting wall.

17. The playstation of claim 16, wherein each swing hanger is pivotally mounted at least partially between the two sidewalls of the respective bracket member.

18. The playstation of claim 17, wherein each swing hanger is constrained laterally between the respective sidewalls to permit substantially only pivoting movement in a plane parallel to the respective sidewalls.

19. The playstation of claim 17, wherein the two sidewalls of each bracket member define a respective channel with no top or bottom wall such that prior to being connected to their respective elongated support members, each swing hanger is free to pivot 360 degrees within the respective channel.

20. The playstation of claim 17, wherein each swing hanger is mounted on a member that does not include a loop or eyelet.

21. The playstation of claim 17, wherein each swing hanger is supported by a support member extending between the sidewalls of the respective bracket member, and wherein no additional part is positioned between the sidewalls of the bracket member and the swing hanger.

22. The playstation of claim 17, wherein each swing hanger is supported by a support member extending between the sidewalls of the respective bracket member, each swing hanger including an insert engaging the support member, and wherein no additional part is positioned between the sidewalls of the bracket member and the swing hanger.

23. The playstation of claim 16, wherein each bracket member includes an alignment tab extending from the mounting wall in a direction opposite the sidewalls, the alignment tab abutting one of a bottom surface and a top surface of the support beam to align the bracket member vertically with respect to the support beam.

24. The playstation of claim 23, wherein the alignment tab abuts the bottom surface of the support beam.

25. The playstation of claim 14, wherein the elongated support members are flexible members.

26. The playstation of claim 14, wherein each of the bracket members includes a mounting wall and two sidewalls extending generally perpendicularly from the mounting wall, and wherein the mounting wall of each bracket member includes an aperture between the respective sidewalls that receives a fastener.

27. The playstation of claim 26, wherein the mounting wall of each bracket member includes two apertures between the sidewalls, both apertures receiving a fastener.

28. The playstation of claim 26, wherein the two sidewalls of each bracket member define a respective channel having a first width in the vicinity of the aperture and a second width in the vicinity where the respective swing hanger is connected, the second width being narrower than the first width.

29. The playstation of claim 14, wherein each bracket member is a one-piece construction.

* * * * *